US009301601B2

(12) United States Patent
Pan

(10) Patent No.: US 9,301,601 B2
(45) Date of Patent: Apr. 5, 2016

(54) HANDS-FREE READING HOLDER

(71) Applicant: Ren-Yang Pan, Taipei (TW)

(72) Inventor: Ren-Yang Pan, Taipei (TW)

(73) Assignee: Ren-Yang Pan, Taipei (TW)

( * ) Notice: Subject to any disclaimer, the term of this patent is extended or adjusted under 35 U.S.C. 154(b) by 0 days.

(21) Appl. No.: 14/832,952

(22) Filed: Aug. 21, 2015

(65) Prior Publication Data

US 2016/0058174 A1 Mar. 3, 2016

(30) Foreign Application Priority Data

Aug. 26, 2014 (TW) ..... 103129431 A

(51) Int. Cl.
*A47B 97/04* (2006.01)
*A47B 23/00* (2006.01)
*A47B 23/06* (2006.01)

(52) U.S. Cl.
CPC ..... *A47B 23/002* (2013.01); *A47B 23/06* (2013.01)

(58) Field of Classification Search
CPC ..... A47B 23/002; A47B 23/06
See application file for complete search history.

(56) References Cited

U.S. PATENT DOCUMENTS 4,852,778 A * 8/1989 Beiser ..... B62J 9/003 224/258
2010/0301188 A1* 12/2010 Schimelfenyg ..... F16M 11/041 248/447.2
2013/0206935 A1* 8/2013 Majid ..... F16M 11/041 248/124.1

* cited by examiner

*Primary Examiner* — Amy Sterling
(74) *Attorney, Agent, or Firm* — AEON Law; Adam L. K. Philipp

(57) ABSTRACT

A hands-free reading holder, comprising a frame assembly, including a first frame member and a second frame member adjustably connected to the first frame member, in which the first frame member includes a transverse shaft; a handbag which accommodates the frame assembly and includes a handles member and a reading-object holder assembly, including a holder member; and a connecting member, in which the holder member carries a reading object, and the connecting member is adjustably connected between the holder member and the transverse shaft, wherein the first frame member, the second frame member, and the reading-object holder assembly each include movable joints thereby providing a plurality of rotary shafts for the holder member.

10 Claims, 4 Drawing Sheets

HANDS-FREE READING HOLDER

FIELD OF THE INVENTION

The present invention relates to a carrier, and more particularly to a hands-free reading holder.

BACKGROUND OF THE INVENTION

There are over three-quarters of the world's population who have been using mobile communication devices such as mobile phones or tablet computers. When using a mobile phone or a tablet computer, a user has to grasp these devices for a long time, in which the posture leads to the suppression of nerves in an arm, and thus the arm becomes numb. When the numbness in arms gets serious, the user often has to go to a doctor. Similarly, when reading books, people need to hold the books with both of their hands. After reading books for a long time, the readers' hands become numb and sore.

In the past, some hands-free devices are introduced to solve the above mentioned problems. The conventional products for mobile phone include earphones and headset-microphone for making and receiving phone calls. With earphones or headset microphones, the users do not need to hold their mobile phone with hands; instead, the users only need to keep the mobile phone fixed in their pockets or in the handbags, or dispose their mobile phone on the mobile phone supporters. On the other hands, the prior products for tablet computers include foldable cover cases which can be folded into necessary shapes to support the tablet computers. Furthermore, some manufacturers develop a kind of hands-free device for books, in which the device includes an adjustable metal tube with a book-clamping tool. The metal tube can be adjusted according to different reading postures such as lying flat position, sitting position, or standing position. Therefore, the readers can read the books without holding them. However, currently there are limited types of hands-free holders. People who want to use hands-free reading devices for mobile phone, tablet computers and books need to buy these three types of hands-free reading devices respectively. Having to separately buy these three types of hands-free reading devices is disadvantageous for the users, since it is costly to buy three kinds of devices. Besides, it is also inconvenient to use three kinds of devices separately.

SUMMARY OF THE INVENTION

Accordingly, the object of the present invention is to provide a hands-free reading holder, in which its portability increases ease-of-use, and its ability to support various reading objects such as mobile phone, tablet computers, and books can lower the purchase cost.

To solve the technical problem in prior art, the technical means adopted by present invention provides a hands-free reading holder, comprising: a frame assembly, including a first frame member and a second frame member adjustably connected to the first frame member, in which the first frame member includes a transverse shaft, and a handbag which accommodates the frame assembly and includes a handles member, and a reading-object holder assembly, including a holder member and a connecting member, in which the holder member carries a reading object, and the connecting member is adjustably connected between the holder member and the transverse shaft, wherein the first frame member, the second frame member, and the reading-object holder assembly each include moveable joints thereby providing a plurality of rotary shafts for the holder member.

According to one embodiment of the present invention, the hands-free reading holder further comprises an auxiliary frame, which is connected to the first frame member.

According to one embodiment of the present invention, the first frame member and the second frame member are adjustably connected together.

According to one embodiment of the present invention, the transverse shaft includes a thread body which distributes over the surface of the transverse shaft.

According to one embodiment of the present invention, the hands-free reading holder further includes a belt annularly which is connected to the bottom of the handbag at both ends.

According to one embodiment of the present invention, the hands-free reading holder further includes a lower supporting member, which is connected between the bottoms of the second frame body.

According to one embodiment of the present invention, the handles member includes an adjustment portion, by which the length of the handles can be adjusted.

According to one embodiment of the present invention, the holder member includes two clamping portions, which clamp the reading object via relative displacement, and the rotary shafts rotate in different directions.

According to one embodiment of the present invention, the frame assembly is covered by an inner surface or an outer surface of the handbag.

According to one embodiment of the present invention, the hands-free reading holder further includes a sling member connected between the handles member and the belt.

According to one embodiment of the present invention, the hands-free reading holder further includes two auxiliary sling members, in which the ends of the two auxiliary sling members are connected to the bottom of the handbag at both sides, and the other ends of the two auxiliary sling members are connected to the handles member and are spaced apart by a proper distance.

The hands-free reading holder of the present invention can hold the reading objects such as mobile phone, tablet computers, or books, and thus can save the cost of buying these three kinds of reading holders. Besides, the hands-free reading holder can be adjusted to adapt to different reading positions, thereby enhancing the reading experience. Furthermore, the hands-free reading holder is foldable, and thus is portable.

DETAILED DESCRIPTION OF THE PREFERRED EMBODIMENTS

The embodiments of the present invention are described below with reference to FIG. 1 to FIG. 4. The description is for describing the preferred embodiments of the present invention, and is not intended to limit the present invention.

Figure 1:
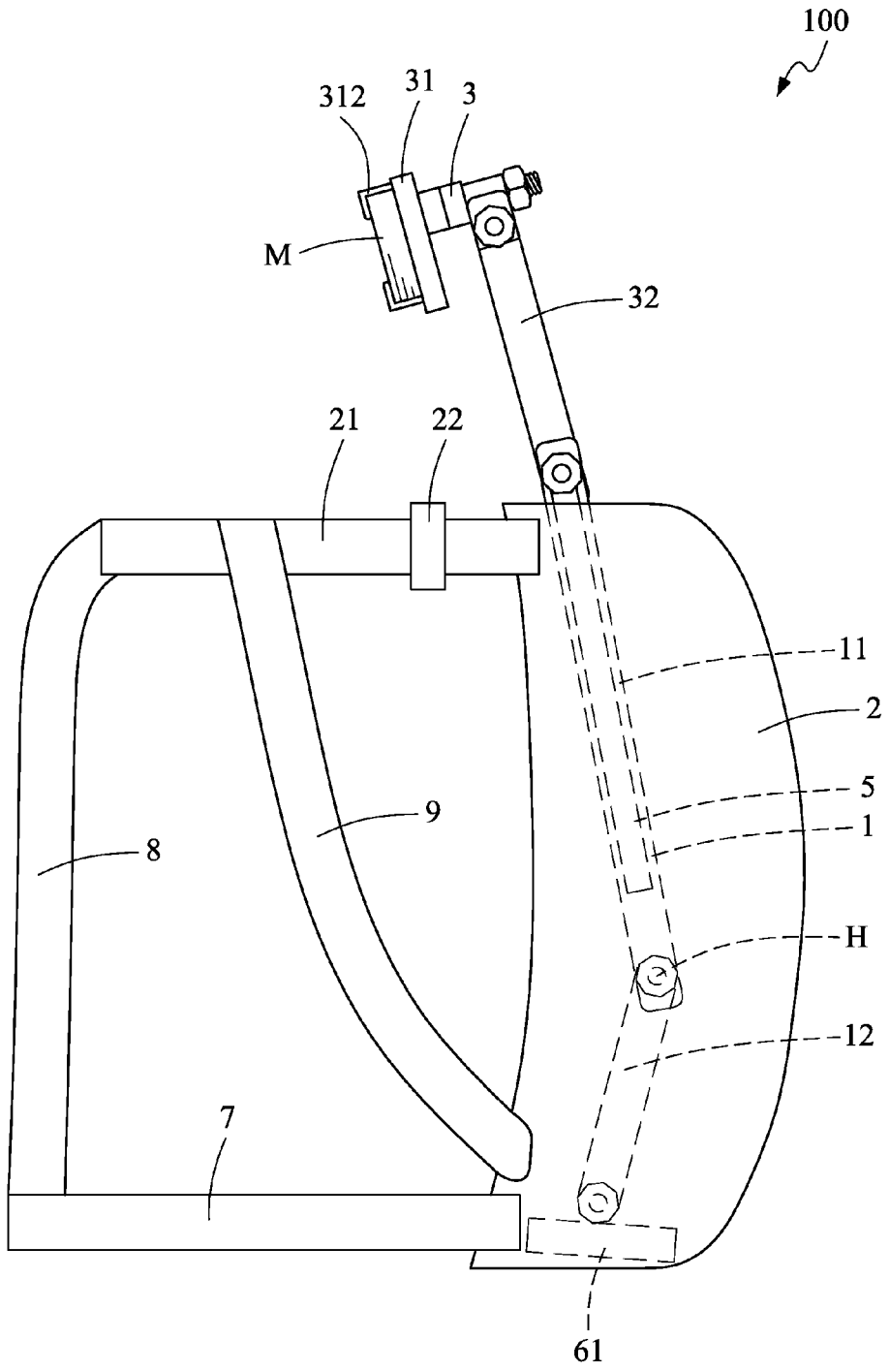
FIG. 1 is a side view illustrating a hands-free reading holder according to one embodiment of the present invention.
Figure 2:
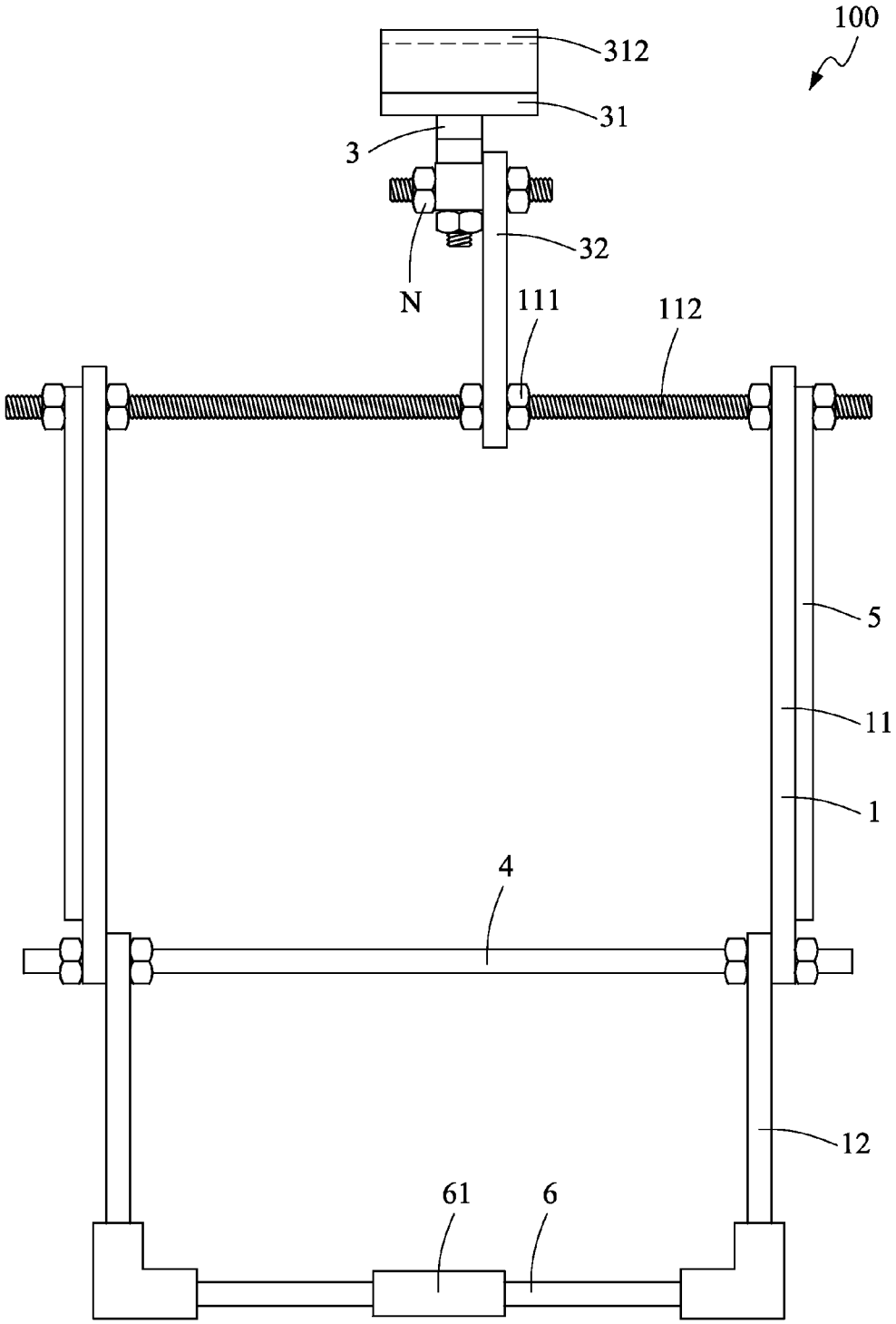
FIG. 2 is a front view illustrating the hands-free reading holder according to the embodiment of the present invention.

As shown in FIGS. 1-2, a hands-free reading holder 100 according to one embodiment of the present invention comprises: a frame assembly 1, a handbag 2, and a reading-object holder assembly 3.

The frame assembly 1 includes a first frame member 11 and a second frame member 12 adjustably connected to the first frame member 11, in which the first frame member 11 includes a transverse shaft 111, and the transverse shaft 111 includes a thread body which distributes over the surface of the transverse shaft.

The handbag 2 accommodates the frame assembly 1. Namely, the handbag 2 covers the frame assembly 1 with its inner surface in such a manner that the hands-free reading holder becomes portable. The handbag 2 includes a handles member 21 for hanging the hands-free reading holder 100 on human body or on other places like wall. Preferably, the handles member 21 includes an adjustment portion 22, by which the length of the handles member 21 can be adjusted.

The reading-object holder assembly 3 includes a holder member 31 and a connecting member 32, in which the holder member 31 carries a reading object M such as mobile phone, tablet computers, and books. The connecting member 32 is adjustably connected between the holder member 31 and the transverse shaft 111.

The first frame member 11, the second frame member 12, and the reading-object holder assembly 3 each include movable joints, which can adjust the angle between the first frame member 11 and the second frame member 12, and the angle between the connecting member 32 and the first assembly 1. Specifically, the relative positions between the first frame member 11, the second frame member 12, and the reading-object holder assembly 3 can be adjusted by utilizing the movable joints, and thus the angles and width of the hands-free reading holder 100 are accordingly adjusted in such a manner that the readers are provided with the most appropriate distance and angle between the eyes and the reading object M.

Figure 3:
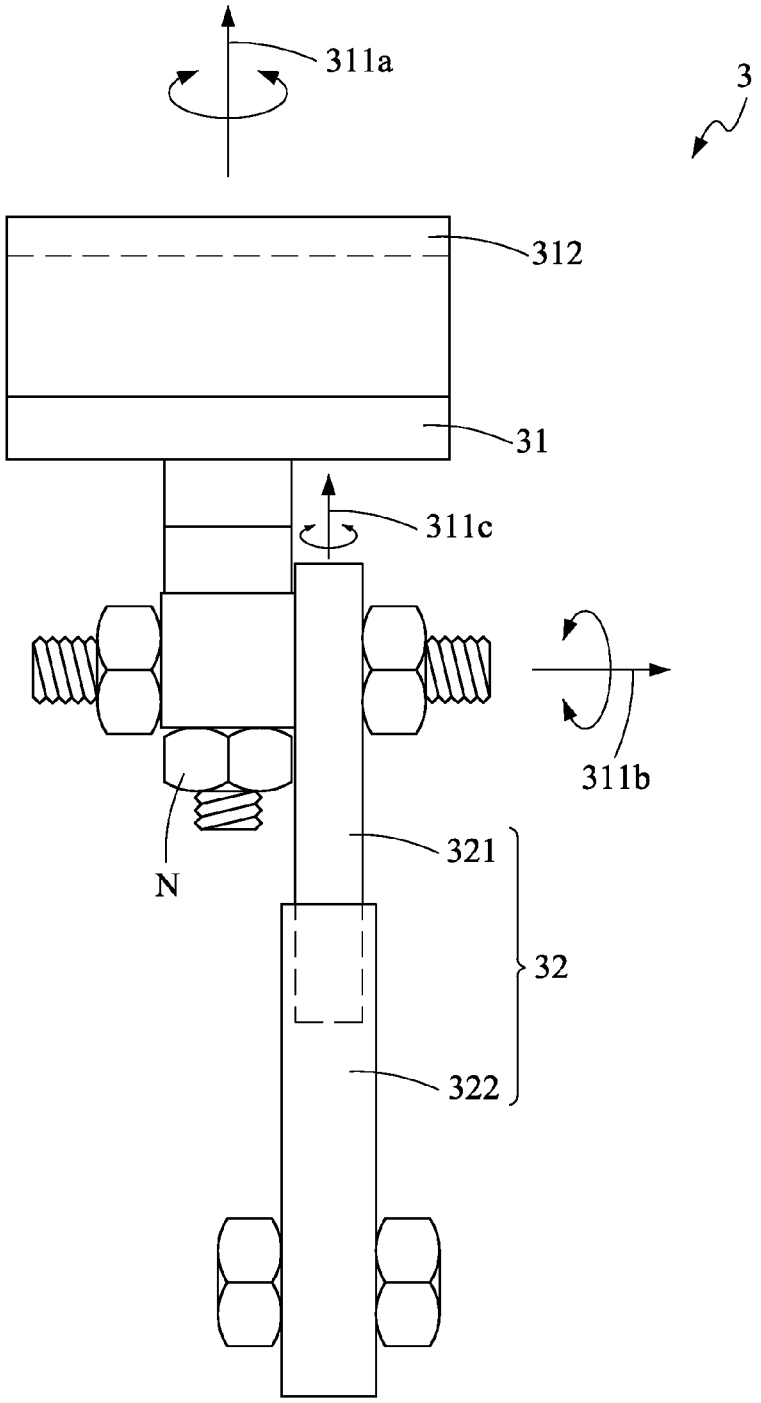
FIG. 3 is a front view illustrating the rotary shafts according to the embodiment of the present invention.

The connecting member 32 can further includes a clamping means, which clamps the transverse shaft 111 after the connecting member 32 is moved to a proper position on the transverse shaft 111. With the clamping means, the position of the connecting member 32 is adjustable and fixable. As shown in FIG. 3, the reading-object holder assembly 3 includes a plurality of movable joints, wherein each movable joint consists of a through hole H and a screw nut N, and via the movable joints, the holder member 31 is provided with a plurality of rotary shafts 311. Preferably, the holder member 31 includes two clamping portions 312, which clamp the reading object M via relative displacement, and the rotary shafts rotate in different directions.

In one embodiment of the present invention, the first frame member 11 and the second frame member 12 are adjustably connected together.

Figure 4:
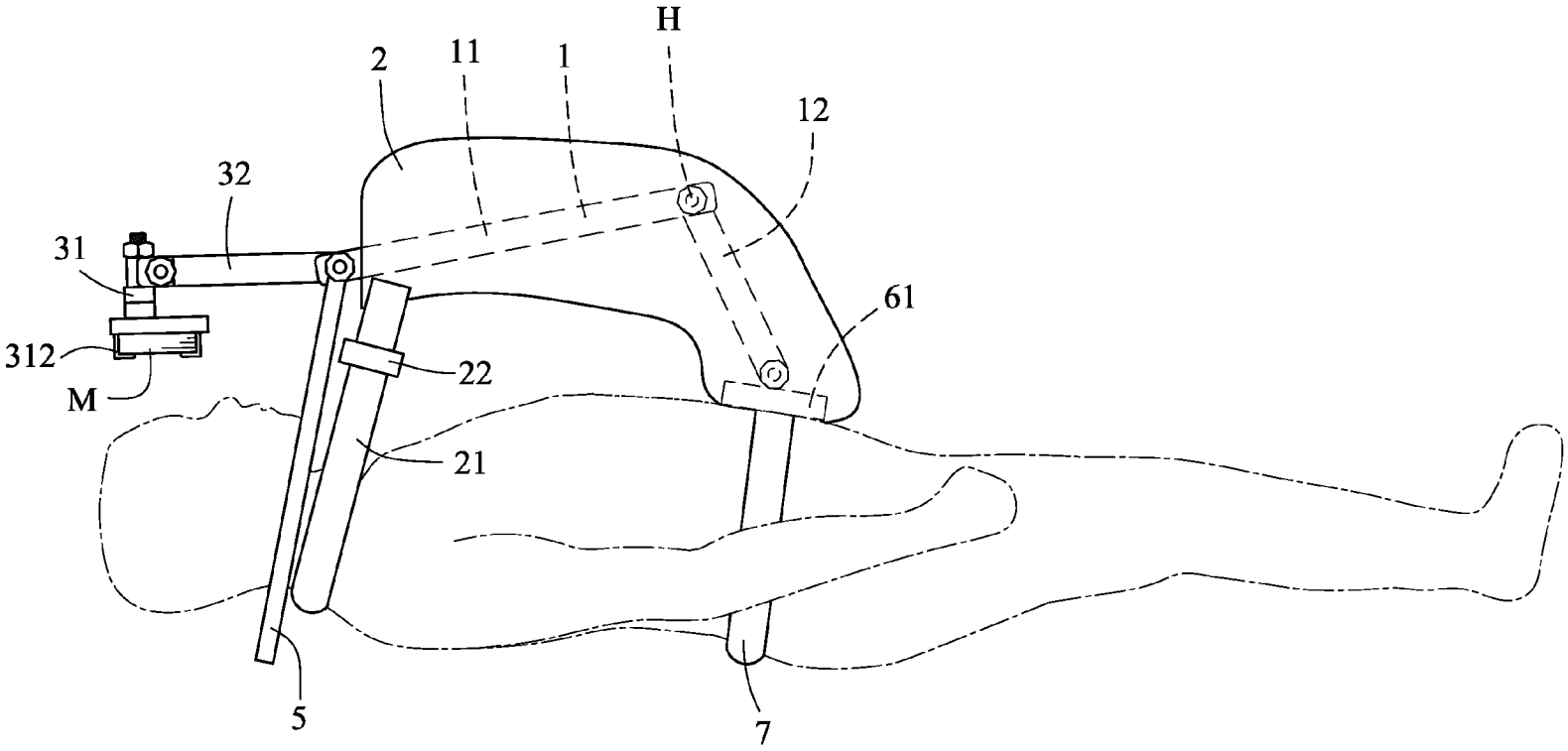
FIG. 4 is a schematic view illustrating the use of the hands-free reading holder according to the embodiment of the present invention.

As shown in FIG. 4, the hands-free reading holder 100 further includes an auxiliary frame 5, which is connected to the first frame member 11. The auxiliary frame 5 is used for supporting the hands-free reading holder on the floor, beds, or the human body, thereby providing convenient and comfortable reading experience for the users when lying down.

As shown in FIG. 1 and FIG. 2, the hands-free reading holder includes a lower supporting member 6, which is connected between the bottoms of the second frame body 12. Specifically, the lower supporting member 6 provides support for the waist and the belly of the human body. The lower supporting member 6 is made of soft materials such as plastic and rubber, and thus offers comfortable support for the users. The lower supporting member 6 can include a soft cushion 61 which fits nicely on the waist and the belly, thereby providing strain relief effect for the human body. Optionally, the hands-free reading holder 100 further includes a belt 7 annularly connected to the bottom of the handbag at both ends. When actually being used, the belt 7 encircles the waist and belly of the human body, thereby fixing the hands-free reading holder 100 onto the waist and the belly. Furthermore, to reduce the strain on the waist and belly generated when the hands-free reading holder 100 is placed against the waist and the belly of the human body, a sling member 8 connected between the handles member 21 and the belt 7 is provided. The sling member 8 can be hung around the neck of the human body, thereby providing support when the hands-free reading holder 100 is carried by a sitting, walking, or standing user. Optionally, the belt 7 and the sling member 8 can be replaced with two auxiliary sling members 9. The ends of the two auxiliary sling members 9 are connected to the bottom of the handbag 2 at both sides, and the other ends of the two auxiliary sling members 9 are connected to the handles member 21 and are spaced apart by a proper distance, wherein the proper distance is in a range from 15 cm to 20 cm.

The above description is only an explanation of the preferred embodiments of the present invention. A person with ordinary skill in the art can make various modifications according to the above description and the claims defined below. However, those modifications shall still fall within the scope of the present invention.

What is claimed is:

1. A hands-free reading holder, comprising:

a frame assembly, including a first frame member and a second frame member adjustably connected to the first frame member, in which the first frame member includes a transverse shaft;

a handbag which accommodates the frame assembly and includes a handles member; and a reading-object holder assembly, including a holder member and a connecting member, in which the holder member carries a reading object, and the connecting member is adjustably connected between the holder member and the transverse shaft, wherein the first frame member, the second frame member, and the reading-object holder assembly each include movable joints thereby providing a plurality of rotary shafts for the holder member.

2. The hands-free reading holder as claimed in claim 1, further comprising an auxiliary frame, which is connected to the first frame member.

3. The hands-free reading holder as claimed in claim 1, wherein the first frame member and the second frame member are adjustably connected together.

4. The hands-free reading holder as claimed in claim 1, wherein the transverse shaft includes a thread body which distributes over the surface of the transverse shaft.

5. The hands-free reading holder as claimed in claim 1, further including a belt annularly connected to the bottom of the handbag at both ends.

6. The hands-free reading holder as claimed in claim 1, further including a lower supporting member, which is connected between the bottoms of the second frame body.

7. The hands-free reading holder as claimed in claim 1, wherein the handles member includes an adjustment portion, by which the length of the handles can be adjusted.

8. The hands-free reading holder as claimed in claim 1, wherein the holder member includes two clamping portions, which clamp the reading object via relative displacement, and the rotary shafts rotate in different directions.

9. The hands-free reading holder as claimed in claim 1, wherein the frame assembly is covered by an inner surface or an outer surface of the handbag.

10. The hands-free reading holder as claimed in claim 1, further including a sling member and two auxiliary sling members, in which the sling member is connected between the handles member and the belt, and an ends of the two auxiliary sling members are connected to the bottom of the handbag at both sides, and the other ends of the two auxiliary sling members are connected to the handles member and are spaced apart by a proper distance.

* * * * *